United States Patent [19]

Larssen

[11] 4,346,544

[45] Aug. 31, 1982

[54] LIGHTWEIGHT BUILDING ELEMENTS WITH HIGH CARRYING CAPACITY

[76] Inventor: Jens-Frederik Larssen, Birger Jarlsgatan 62, 114 29 Stockholm, Sweden

[21] Appl. No.: 43,824

[22] Filed: May 30, 1979

Related U.S. Application Data

[63] Continuation-in-part of Ser. No. 950,291, Oct. 11, 1978, abandoned, which is a continuation of Ser. No. 569,592, Apr. 21, 1975, abandoned.

[51] Int. Cl.[3] ..... E04C 1/24

[52] U.S. Cl. ..... 52/407; 52/220; 52/481; 52/731; 52/795

[58] Field of Search ..... 52/144, 145, 220, 221, 52/404, 480, 366, 731, 732, 630, 366, 795, 801, 481, 407; 14/1, 6, 73

[56] References Cited

U.S. PATENT DOCUMENTS

| | | | |
|---|---|---|---|
| 1,896,769 | 2/1933 | Davis | 52/484 |
| 2,161,708 | 6/1939 | Heerwagen | 52/144 |
| 2,164,138 | 6/1939 | London | 52/407 |
| 2,230,628 | 2/1941 | Sahlberg | 52/731 |
| 2,444,133 | 6/1948 | Groat | 52/481 |
| 3,173,523 | 3/1965 | Mote | 52/222 |
| 3,241,285 | 3/1966 | Baroni | 52/731 |
| 3,465,486 | 9/1969 | Rolin | 52/222 |
| 3,759,006 | 9/1973 | Tamboise | 52/814 |
| 4,125,977 | 11/1978 | Michlovic | 52/220 |

FOREIGN PATENT DOCUMENTS

| | | | |
|---|---|---|---|
| 1363181 | 4/1964 | France | 52/795 |

*Primary Examiner*—John E. Murtagh

*Attorney, Agent, or Firm*—Larson and Taylor

[57] ABSTRACT

A building element includes a number of lightweight carrier elements, each of which includes a lower base member formed of an upwardly opened box made of a thin plate of material with horizontally directed flanges. Surface layers lie above the lower base members and are connected thereto by glue joints extending completely over the flanges. Adjacent carrier elements may be joined at their surface layers by locking elements and fillets may be provided for joining adjacent base members.

18 Claims, 15 Drawing Figures

FIG. 1
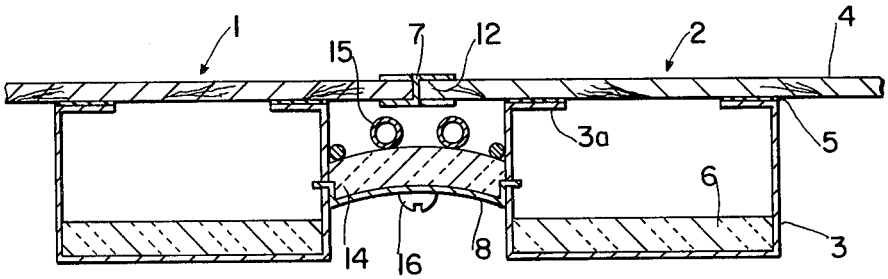
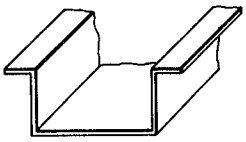
FIG. 2a
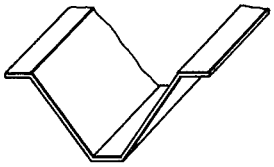
FIG. 2b
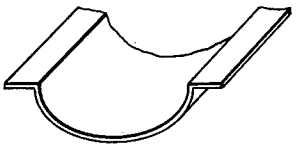
FIG. 2c
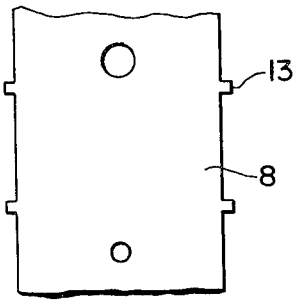
FIG. 3
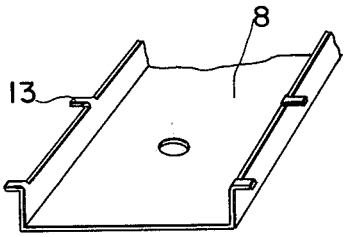
FIG. 4

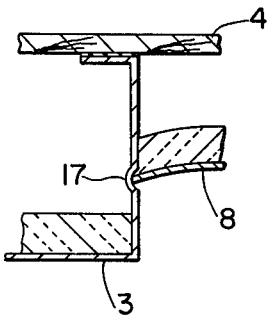
FIG. 5
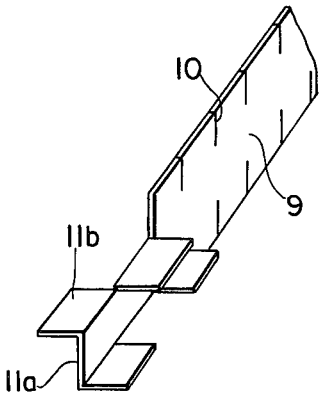
FIG. 6
FIG. 7
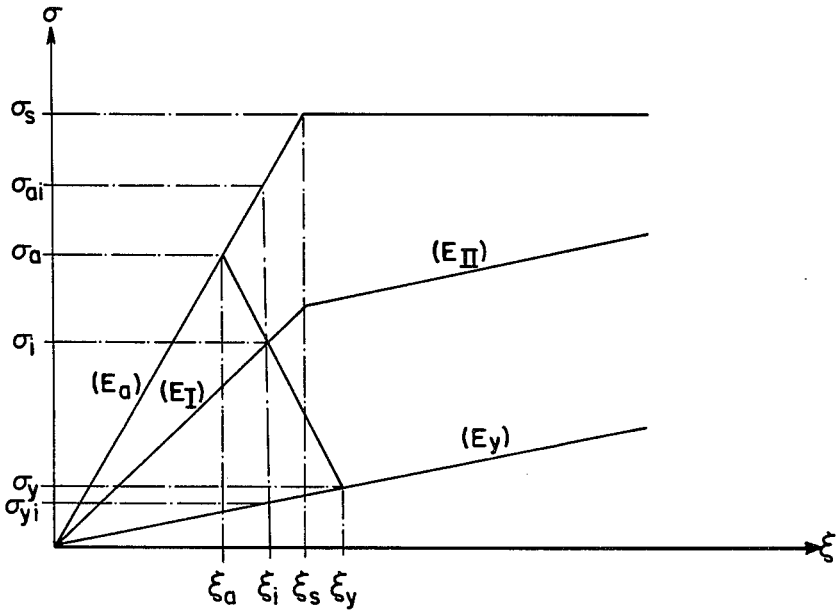

LIGHTWEIGHT BUILDING ELEMENTS WITH HIGH CARRYING CAPACITY

This application is a continuation-in-part of applicant's previously filed application, Ser. No. 950,291, filed Oct. 11, 1978, which is in turn a continuation of application Ser. No. 569,592, filed Apr. 21, 1975 now abandoned.

The present invention relates in general to building elements, and more particularly to building elements made of so called "lightweight structural elements".

"Lightweight structural elements" in the present context refer to interconnected carrier casettes or elements comprising a base member of sheet metal which is covered on one side with a surface layer of another, and stiffer, material. It is known that thin plate materials have a rather poor ability to withstand pressure forces but a good ability to withstand tension forces, while, on the other hand, layers such as wood have a good ability to withstand pressure forces, since the pressure forces are distributed over substantially the entire portion of the cross-section area for wooden materials, such as plywood, which have good stiffness properties. In accordance with the present invention, the base members and surface layers are firmly connected together by means of a glue joint to form a solid unit in which the two components interact statically. Such structural elements have great bending strength where the surface layer is positioned to withstand the pressure zone. The ultimate result is a very lightweight unit with extraordinarily good carrying properties.

More specifically, one aspect of the present invention concerns a building member defined by a number of interconnected lightweight carrier elements. Each carrier element comprises at least one lower base member for receiving tension forces which includes an upwardly open box made of thin sheet metal plate material and which has horizontally directed flanges at the upper edges thereof. Each carrier element further comprises an upper surface layer for receiving pressure forces in the building element which is made of a wood material that is stiffer in all directions than the sheet metal plate of the at least one lower base member. The surface layer is wider than its corresponding at least one lower base member and extends longitudinally beyond its at least one lower base member on both sides thereof. The surface layer is firmly connected directly to the at least one lower base member through a body of glue which forms a glue joint extending over the entire upper surfaces of the corresponding at least one base member flanges so that the surface layer and at least one lower base member constitute a statically cooperating and interacting unit in which the at least one lower base member and surface layer function as a one piece integral element.

In accordance with a further aspect of the invention, a wooden bar is disposed between the surface layer and each base member flange of a carrier element. The wooden bars are firmly connected in the manner described above by glue joints both to the surface layer and to the corresponding lower base member flanges so as to form a statically cooperating and interacting unit in which all of the various components thereof function as a one piece integral element.

In accordance with a still further aspect of the present invention, a wooden bar is disposed within the box of the at least one lower base member of each carrier element and firmly connected directly to the base thereof in the manner described above by a glue joint such that a statically cooperating interacting unit is formed which has an increased ability to withstand pressure forces.

In accordance with another aspect of the invention, a corrugated plate is connected to the bottom of the at least one lower base member, preferably by mechanical fasteners. A layer of insulating material preferably is disposed between the corrugated plate and the at least one lower base member.

In accordance with still another aspect of the invention, the carrier elements are fixedly mounted in relation to each other by means of locking elements provided at the joints of the surface layers. Removably mounted filling casettes may also be mounted between the carrier elements, which may be formed with any suitable isolation and in which pipes, conduits, and the like may be provided.

Building elements constructed in accordance with the present invention may be used for roofs, intermediate joists, walls, etc., and are particularly suited for use where the building element is to be mounted between horizontally spaced apart supporting points, with its upper surface extending horizontally to be loaded downwardly from above onto its upper surface, and such that a downwardly directed load received onto the building element is transmitted horizontally therethrough to the supporting points. As compared with conventional structures, the use of such building elements leads to several substantial advantages. The interaction between the base member(s) and the surface layer allows the surface layer to function both as a load support and as a covering material. Without decreasing the load supporting and stiffness properties, a lighter building element for larger bearing distances is obtainable with less need of material than is possible with conventional building techniques. Further, the material of the surface layer may be selectively chosen depending on building requirements and the intended function of the building element. Carrier elements may be manufactured in accordance with the present invention in any large lengths, and substantial investment in manufacturing equipment is not required. In fact, if desired, the readily pileable base members and the surface layers may be delivered separately and may be glued together at the workplace, which also reduces transport costs. It is further possible to use a cheaper isolating material than previously, and pipes, conduits, and exits for electricity, water, ventilation etc. may be provided within the lightweight elements. In summary, all the aforementioned advantages contribute to provide an economical and easily mountable lightweight building element which uses little material, which is easily manufactured, which is suitable for large bearing distances, and which may be re-used.

Other features and advantages of the invention will be set forth in, or apparent from, the detailed description of the preferred embodiments found hereinbelow.

The invention will now be described in more detail with reference to the accompanying drawings. In the drawings, FIG. 1 shows a cross-section through a building element made of a first embodiment of carrier elements constructed according to the present invention.

FIG. 1A is a schematic plan view showing a plurality of carrier elements mounted between horizontally spaced apart supporting points. The line 1—1 in FIG. 1A illustrates the plane along which FIG. 1 is taken.

FIGS. 2*a*, 2*b*, and 2*c* are fragmentary perspective views of three different embodiments of the base member for the carrier element.

FIGS. 3 and 4 are bottom and perspective views, respectively, of a filling casette;

FIG. 5 is a cross-sectional view showing a modification; and

FIG. 6 shows one embodiment of a locking element for the carrier elements.

FIG. 7 is an explanatory stress-strain diagram showing the curves for the components of a carrier element constructed according to the invention, and the interaction thereof.

Figure 1A:
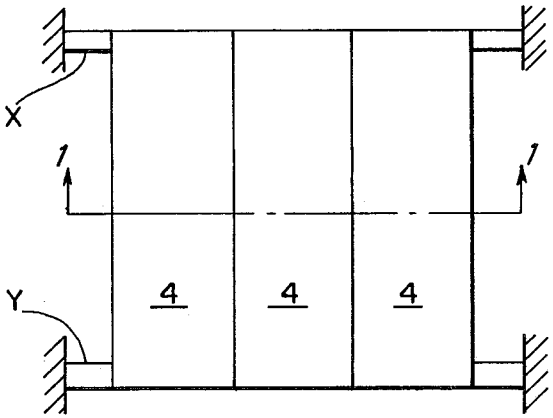
Figure 12:
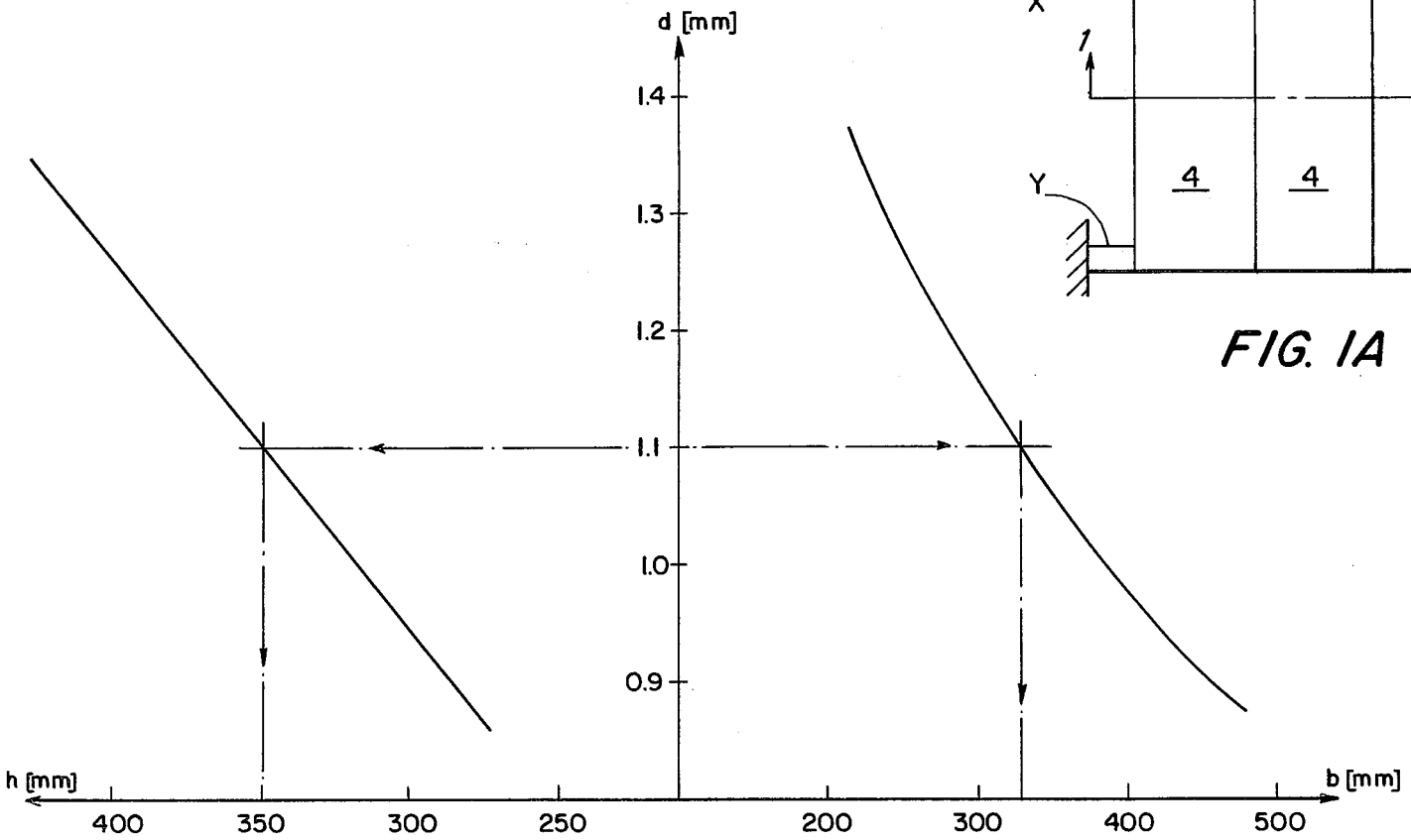
FIG. 12 is a graphical representation of the optimum dimensions of the base member for an embodiment of a carrier element constructed according to the present invention.
Figure 8:
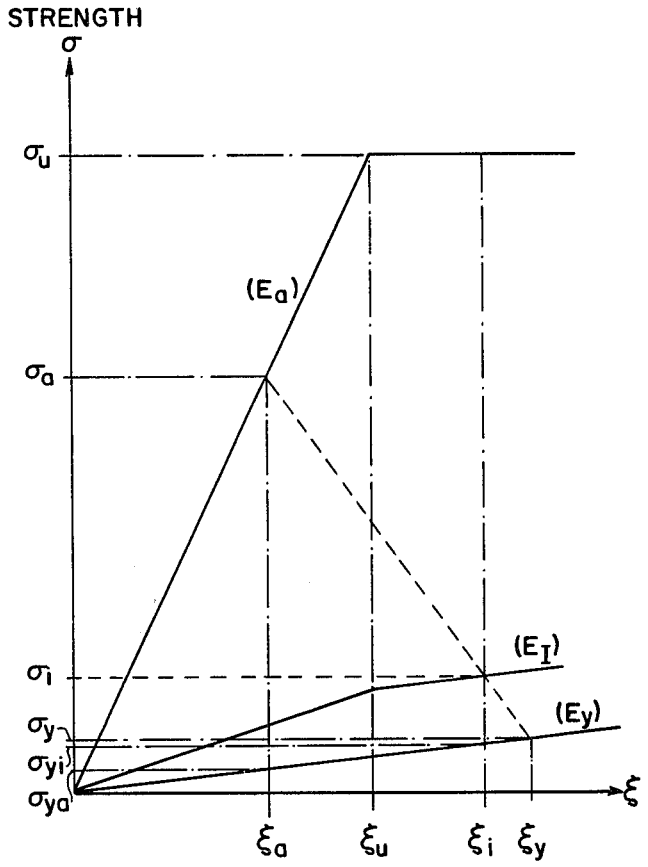
FIG. 8 is a stress-strain diagram illustrating the advantage of the glue joint of the present invention over a mechanical joint.

A building element according to the invention comprises a number of interconnected carrier elements, two of which, denoted 1 and 2, respectively, are shown in FIG. 1. A plurality of such carrier elements shown mounted between horizontally spaced apart supporting points X and Y are shown schematically in FIG. 1A. Each carrier element comprises at least one lower base profile, or member 3 of sheet metal for receiving tension forces, and an upper surface covering, or layer, 4 of other material for receiving pressure forces. Base member 3 may be manufactured of any suitable thin sheet metal material like steel or aluminum, and surface layer 4 may be made of a wood material like plywood, board or particle board, or may be made of synthetic resin material, or of asbestos, cement material, gypsum or the like, or other material which is essentially stiffer in all directions than the sheet metal material of which base member 3 is made.

Base member 3 is configured so as to define an upwardly open box, the upper edges of which have horizontally directed flanges 3*a*. The box profile, or shape, may be varied as desired, with several exemplary shapes being illustrated in FIGS. 1, 2*a*, 2*b*, and 2*c*. In addition, flanges 3*a* may be turned in towards each other, as shown in FIG. 1, or turned out away from each other, as shown in FIGS. 2*a*–2*c*.

Surface layer 4 is wider than and extends longitudinally on both sides beyond, the corresponding base member or members 3.

The base member or members 3 and corresponding surface layer 4 comprising the carrier element embodiment shown in FIG. 1 are firmly connected together directly through a body of glue which forms a glue joint 5 extending over the entire upper surface of each base member flange 3*a* so that surface layer 4 and lower base member(s) 3 provide a statically cooperating and interacting unit in which the components thereof act or function as a one piece integral element.

Figure 9:
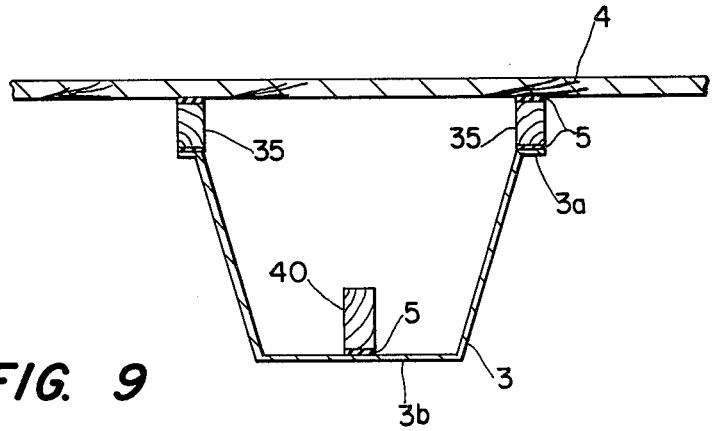
FIG. 9 shows a cross-section through a building element made of a second embodiment of carrier elements constructed in accordance with the present invention.

Referring to FIG. 9, in which like elements have been denoted with like reference numerals, a carrier element constructed in accordance with the present invention advantageously also is provided with a beam or bar 35 disposed between surface layer 4 and each base member flange 3*a* and firmly connected by glue joints 5 of the type described hereinabove both to surface layer 4 and to the corresponding base member flange 3*a* so as to form a statically cooperating and interacting unit in which all of the components thereof function as a one piece integral element. Preferably bars 35 are dimensioned such that the surfaces in contact with flanges 3*a* are coextensive in area therewith.

Still referring to FIG. 9, a carrier element constructed in accordance with the present invention further advantageously comprises a wooden beam or bar 40 disposed within the box defined by each base member 3 and firmly connected directly to the base 3*b* thereof by a glue joint 5 of the type described hereinabove such that a statically cooperating and interacting unit is formed with an increased ability to withstand pressure forces. Preferably bar 40 is longitudinally disposed within base member 3.

Figure 10:
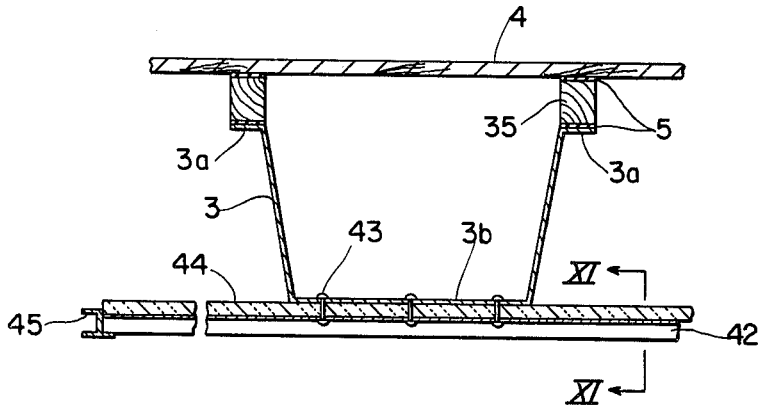
FIG. 10 shows a cross-section through a building element made of a third embodiment of carrier elements constructed in accordance with the present invention, and, FIG. 11 is a view taken along line X1—X1 of the carrier element embodiment illustrated in FIG. 10.
Figure 11:
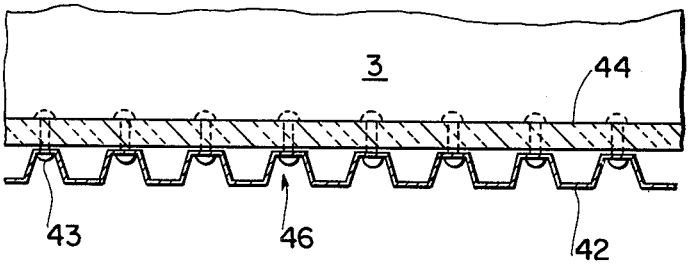

Referring to FIGS. 10 and 11, in which like elements have been denoted with like reference numerals, a carrier element constructed in accordance with the present invention advantageously is provided with a cross corrugated plate 42 mounted to base 3*b* of base member 3 by rivets 43, or other conventional mechanical fastening means. As shown, plate 42 is disposed such that the longitudinal axes of the channels, generally denoted 46, which are formed by the corrugation are transverse to the longitudinal axis of base member 3.

Preferably, as shown, a layer of insulating and fire retardant material 44 is disposed between the bottom of base member 3 and plate 42, which functions as a sound and heat insulating layer, and as a fire barrier to protect surface layer 4 and bars 35 from fire in an area beneath the carrier elements.

Plate 42 preferably extends across the entire width of a carrier element and preferably extends longitudinally so as to be joined on either side by an angle bar 45 or the like to the corresponding plates 42 of adjacent carrier elements. An embodiment of a carrier element has proven satisfactory in use wherein base member 3 is made from 0.8–1.6 mm thick steel plate, insulating material 44 comprises a 20–50 mm thick layer of rockwool or mineral wool, and plate 42 is made from 0.6 mm thick steel plate.

Advantageously, a base member is provided in the interior thereof with an isolating material 6, as shown in FIG. 1.

The carrier elements of the present invention may be manufactured in any suitable lengths in a factory and may be cut upon need at the workplace. It is also possible to manufacture the base members and surface layers separately and to join the components at the workplace.

The connection of the carrier elements to provide a building element may be made both with the aid of locking profiles, or elements, 7 and filling casettes 8 provided between adjacent base members.

The locking elements 7 may have any desired configuration adapted to lock the adjacent edges of surface layers 4, and thereby interconnect adjacent carrier elements. In FIG. 6 one example of a preferred locking element is shown which comprises a sheet metal strip 9 formed with a number of slots 10 extending from the longitudinal edge some distance toward the center of strip 9. By folding the parts of the sheet metal strip located between slots 10 aternately to the left and to the right both at the upper edge and the lower edge, as illustrated in the lower part of FIG. 6, a rib 11*a* is obtained from which extends a number of locking ears 11*b*. In the operative position of the illustrated locking element embodiment, rib 11*a* extends along the adjacent edges of the carrier elements to be connected together and locking ears 11*b* contact both the upper and lower surfaces of adjacent surface layers 4. In order to facilitate the locking, the locking ears 11*b* may be preformed along one edge only of a sheet metal strip 9, and the ears on the opposite side of the strip are formed as described hereinabove with strip 9 in the operative position of the locking element such that the preferomed ears 11*b* engage one of the surfaces of surface layer 4. Locking ears 11*b* may also have jags, as shown, engaging surface layers 4.

Between each of the members 3 a filling cassette 8 of a suitable material may be mounted. Cassette 8 may be concavely formed as shown in FIG. 1, or may be linearly or convexly or otherwise formed. For mounting purposes, cassette 8 may be formed with projecting pins 13 extending through corresponding holes in the sides of base members 3. Alternatively, adjacent base members 3 may be formed with opposing grooves 17 which receive the side edges of a filling cassette 8. Filling cassettes 8 may be mounted at any suitable height in relation to base members, e.g., so as to be aligned with bases 3*b* of the base members, or, as shown in FIG. 1, so as to be somewhat raised or stepped from bases 3*b* of the base members. Mounting the filling cassettes at such a stepped level may be advantageous from both an acoustic and an aethetic viewpoint. On the upper side of each filling cassette 8 a layer 14 of isolating material may be provided, and within, or on top of, isolation layer 14 pipes or conduits 15 for electricity, water, telephone, air conditioning and the like may be provided. At the underside of the filling cassettes corresponding sockets or fittings 17 may also be provided.

According to the invention a statically interacting unit is obtained by means of a glue joint of the type described hereinabove between the surface layer and base member(s) of each carrier element. The complete interaction provided by the glue joint is essential to achieving the extremely good supporting properties provided by carrier elements constructed according to the present invention. To explain the reasons for this, reference is made to FIG. 7 of the drawings, which shows a stress-strain diagram in which the pressure stresses of the different components and the ideal pressure stress of the combined carrier element are plotted along the vertical axis and in which the strain is plotted along the horizontal axis. As will be shown, by the complete interaction which is provided by the glue joint between a plywood plate constituting surface layer 4 and sheet metal material forming the glued base member, it is possible, without affecting the safety demands for the combined structural element, to exceed the normally allowed stress for the sheet metal material within the area at and close to the upper flanges of the base member.

Referring to FIG. 7, curve Ea indicates the elasticity modulus of the sheet metal material, curve Ey indicates the elasticity modulus of the plywood material, and curve $E_I$ indicates the elasticity modulus for a completely interacting lightweight building element. If the area of the surface layer material is designated Ay and the area of the sheet metal material defined by the glued flanges is designated Aa, the ideal elasticity modulus $E_I$ for the combined structural element is obtained by the following:

$$E_I = \frac{Ey \cdot Ay + Ea \cdot Aa}{Ay + Aa}$$

In FIG. 7, $\sigma$a indicates the normally allowed stress of the sheet metal material and $\sigma$y the normally allowed stress of the plywood material. If the intersection point between $\sigma$a and the curve Ea is joined by a connection line with the intersectional point between $\sigma$y and the curve Ey, the connection line cuts the curve for the ideal elasticity modulus $E_I$ at the point ($\sigma$i; $\epsilon$i). This indicates that, by interaction between the surface layer plate and the glued base member flanges, the stress of the bonded sheet metal material, $\sigma$ai, is stronger, for a strain $\epsilon$i, than the normally allowed stress $\sigma$a of the sheet metal material, and that the stress of the plywood material, $\sigma$yi, is lower than the normally allowed stress $\sigma$y for plywood material.

It is consequently possible by means of the complete interaction of the two components to increase the $\sigma$-value for the sheet metal material as compared with a carrier element wherein a sheet metal base member and a plywood material surface layer are connected by a mechanical or other joint not giving the complete interaction provided by the glue joint. Indeed, the glue joint of the present invention gives a moment receiving ability which is about 2.22 times better than a mechanical joint for exactly the same base member and surface layer. It is therefore possible to achieve, without increasing the dimensions of the building element components, a substantially increased support strength over that which is provided by a building element employing a mechanical joint. This can be shown by way of the following example which explains the significance of the glue joint in obtaining complete co-action between the base member plate and the surface layer. In the example, plywood was used in the calculations.

Referring to FIG. 9:

The plywood is of a kind having a permitted pressure strength

| | |
|---|---|
| in the fiber direction: | $\sigma_t = 13.2$ N/mm$^2$ |
| Elasticity modulus: | Ey $= 0.99 \times 10^4$ N/mm$^2$ |
| Corresponding to upsetting: | $\epsilon y = 1.33 \times 10^{-3}$ |
| The plate has a: | |
| Elasticity modulus: | Ea $= 21 \times 10^4$ N/mm$^2$ |
| Allowed pressure strength: | $\sigma a = 120$ N/mm$^2$ |
| Corresponding upsetting: | $\epsilon a = 0.57 \times 10^{-3}$ |
| Yield point strength: | $\sigma u = 180$ N/mm$^2$ |
| Corresponding upsetting: | $\epsilon u = 0.857 \times 10^{-3}$ |

When using a mechanical joint according to the given example:

$Y_O = 77$ mm, $\epsilon ai = \epsilon y = 0.57 \times 10^{-3}$. For the calculations $\sigma a = 53.3$ N/mm$^2$, $\sigma ai = 120$ N/mm$^2$ and $\sigma y = 5.6$ N/mm$^2$ (compare the "working curves" for plate and plywood). The moment receiving ability: $M_{all} = 166 \times 10^5$ N×mm.

When using a glued joint a complete co-action is obtained between the plywood and the plate, whereby an increase of the plate strength and a reduction of the plywood strength in relation to what is normally allowed do not reduce the safety of the structure itself. For this calculation:

$Y_O = 75$ mm, $\epsilon a = 0.542 \times 10^{-3}$, $\sigma a = 113.8$ N/mm$^2$ $\sigma ai = \sigma u = 180$ N/mm$^2$ and $\sigma y = 13.2$ N/mm$^2$ (compare the working curves). The moment receiving ability: $M_{all} = 369 \times 10^5$ N×mm.

As is evident from the above, the allowed moment receiving property for the glue joint is $369 \times 10^5$ N×mm and for the mechanical joint only $166 \times 10^5$ N×mm. This means that one will obtain a moment receiving ability for a lightweight structure constructed according to the present invention which is 369/166, or 2.22 times higher than when using a mechanical joint.

Hence, the provision of a glued joint for creating unified interaction between an upper surface layer positioned to receive the downwardly directed forces such as the weight of objects and the like and a lower thin plate base member represents a major improvement over the prior art.

Referring to FIG. 7, it is also to be noted that a relative increase in the area of the plywood material constituting the surface layer in relation to the areas of the sheet metal material at the glue flanges of the base member produces a curve for $E_I$ which comes closer to the working curve Ey for the plywood material. The relative load of the plywood within the combined carrier element also increases, and the stress $\sigma yi$ of the plywood plate comes closer to $\sigma y$, while the stress $\sigma ai$ of the sheet metal at the glue flange increases and comes closer to the yield point $\sigma s$. This is possible without risking the safety of the structure as a complete unit since the reduced safety of the sheet meal material is compensated by the increased safety of the plywood material.

it is also to be noted that the use of wooden bars 35 between flanges 3*a* and support layer 4 in the manner described hereinabove substantially increases the pressure support ability of layer 4. As a consequence, the width or thickness of layer 4 may be reduced without reducing the moment receiving ability of a carrier element having a given base member 3, which allows lighter and cheaper building elements to be produced. Alternatively, the thickness of layer 4 may be maintained the same as would be employed for the building element embodiment illustrated in FIG. 1, and the width of base portion 3*b* of base member 3 may be increased, depending on the degree of unbalance between the pressure stiffness of layer 4 and the tension stiffness of base member 3, so as to increase the tension stiffness of the base member 3, until it is balanced with the pressure stiffness of the combined interacting unit of layer 4 and bars 35. A building element having an increased total load ability is thereby obtained.

As a further alternative, the use of bars 35 also allows the height of base members 3, defined as the distance between base 3*b* and flanges 3*a*, to be reduced, thereby allowing a low profile building element to be produced. Reducing the height of base member 3 also provides a greater shear strength, which allows a thinner material to be used for base member 3. FIG. 10 illustrates the relationships of the height h of base member 3 and the width b of base 3*b* to the thickness d of the plate material forming base member 3. As an example, the optimum height h for base member 3 using 1.1 mm thick plate material is approximately 350 mm and the optimum width b for base 3*b* is approximately 330 mm. As will be apparent to those of ordinary skill in the art from FIG. 10, the optimum base member height decreases and the optimum base width increases as the plate thickness decreases. Conversely, it can be seen that the optimum base member height increases and the optimum base width decreases as the plate thickness increases.

The use of wooden bars 35 also results in a building element having a very good moment receiving ability. As an example, calculating the maximum allowed torque for a building element using base member plate material having a maximum allowed tensile strength $\sigma_a$ of 233 MPa and a thickness of 1.1 mm (which in reality actually would only be 1.04 mm since there typically is a zinc coating of 0.06 mm on steel plate), and a plywood surface layer having a thickness of 16 mm corresponding to an effective thickness of 9.51 mm and having an elasticity modulus $Ey = 0.6 \times 10^4$ and a maximum allowed pressure strength $\sigma_y$ of 7.0 MPa, a maximum allowed moment support ability of no less than 4,500 Kilogrammeters is obtained. This figure is all the more remarkable when it is noted that (a) a safety factor of 350/233, or 1.5, based on the yield point of steel being 350 MPa, has been used, and (b) rather low values for the elasticity modulus Ey and the maximum allowed pressure strength $\sigma_y$ for plywood have been used.

Still further, the use of bars 35 also has the advantage of providing a thermal barrier between layer 4 and base member(s) 4 of a carrier element, which improves the utility of such carrier elements for both hot and cold climates.

The use of bars 40 joined to the bases of base members 3 in the manner described hereinabove increases the ability of base members 3 to withstand pressure forces. The utility of carrier elements so provided is thereby enhanced for such applications as roof construction, where strong winds can create suction forces on the outside of a roof which subject base members 3, and particularly the bases 3*b* thereof, to pressure forces which they are not intended to withstand.

The function of plate 42 is to act as an intermediate plate which increases the stability of base member 3 and which reduces any tendancy of base member 3 to buckle as a result of pressure forces acting from underneath a carrier element. As a consequence, the load supporting ability of a carrier element so provided is increased.

In a practical embodiment of the invention a beam structure for a plane roof having a bearing distance of 12 meters was built by means of lightweight carrier elements constructed in accordance with the present invention. The base members had a profile height h of 25 cm and were made of thin sheet metal having a thickness of 1.0–1.25 mm. The distance between base members was 120 cm, and the width of each base member was 60 cm. The surface layers were made of plywood having a thickness of 19 mm. Calculations and practical tests showed that this lightweight roof had a quite safe support ability despite having a large bearing distance and a relatively large distance between the base members.

Although the invention has been described with respect to exemplary embodiments thereof, it will be understood that variations and modifications can be effected in the embodiments without departing from the scope or spirit of the invention.

I claim:

1. A lightweight carrier element for forming a building element made of a number of interconnected lightweight carrier elements, the building element being mounted between horizontally spaced apart supporting points with its upper surface extending horizontally to be loaded downwardly from above onto its upper surface, and such that a downwardly directed load received onto the building element is transmitted horizontally therethrough to the supporting points, said lightweight carrier element comprising at least one lower base member for receiving tension forces, said at least one lower base member including an upwardly open box made of thin sheet metal plate material and having at its upper edges horizontally directed flanges, and an upper surface layer for receiving pressure forces in the building element and made of wood material which is essentially stiffer in all directions than the sheet metal plate of said at least one lower base member, said surface layer being wider than, and extending longitudinally beyond both sides of, its corresponding at least one lower base member, a wooden bar disposed between each of said lower base member flanges and said surface layer, each wooden bar being firmly connected to each of the lower base member and the surface layer by a continuous glue joint such that said wooden bars, surface layer, and at least one lower base member function as a one piece integral element to provide a statically cooperating and interacting carrier unit.

2. The carrier element of claim 1 further comprising a wooden bar disposed within said box of said at least one lower base member and firmly connected to the base surface of said box by a glue joint such that said wooden bar and said lower base member function as a one piece integral element to provide a statically cooperating and interacting unit with an increased ability to withstand pressure forces.

3. The carrier element of claim 2 wherein said wooden bar is longitudinally disposed within said box.

4. A building element made of a number of interconnected ones of the carrier element of claim 1, said building element being mounted between horizontally spaced apart supporting points with its upper surface extending horizontally to be loaded downwardly from above onto its upper surface layer and such that a downwardly directed load received onto said building element is transmitted horizontally therethrough to the supporting points, and wherein the connection of each carrier element to its adjacent carrier element is provided by a locking element which includes a rib part extending along the adjacent edges of the upper surface layers and locking ears which contact the upper and lower surfaces of the adjacent upper surface layers.

5. A building element according to claim 4, including a filling cassette bridging the space between lower base members of adjacent carrier elements.

6. A building element according to claim 5, wherein the filling cassette includes pins which engage corresponding holes in the sides of the adjacent lower base members.

7. A building element according to claim 5, wherein the filling cassette has continuous outwardly extending side edges which engage longitudinal grooves in the sides of the adjacent base members.

8. A building element according to claim 5, wherein the lower surface of the filling cassette is curved about an axis parallel to its side edges.

9. A building element according to claim 5, wherein the filling cassette includes a space therein for carrying pipes, conduits and the like.

10. A building element according to claim 5, wherein at least some of the lower base members, along the bottom or sides thereof, and the filling cassettes are provided with isolating material.

11. A building element according to claim 1, wherein the lower base member is either steel or aluminum.

12. The carrier element of claim 1 further comprising a corrugated plate connected to the bottom of said at least one lower base member.

13. The carrier element of claim 12 further comprising mechanical fastening means for connecting said corrugated plate to said at least one lower base member.

14. The carrier element of claim 12 further comprising a layer of insulating material disposed between said corrugated plate and said at least one base member.

15. A building element made of a number of interconnecting ones of the carrier element of claim 12, said building element being mounted between horizontally spaced apart supporting points with its upper surface extending horizontally to be loaded downwardly from above onto its upper surface, and such that a downwardly directed load received onto said building element is transmitted horizontally therethrough to the supporting points, and wherein the connection of each carrier element to its adjacent carrier element is provided by a locking element which includes a rib part extending along the adjacent edges of the surface upper layers and locking ears which contact the upper and lower surfaces of the adjacent surface layers, and by a connecting element which joins adjacent ones of said corrugated plate together along the opposing sides thereof.

16. The carrier element of claim 1 further comprising stiffening means connected to the base of said at least one base member for providing an increased ability to withstand upwardly directed pressure forces.

17. The carrier element of claim 16 wherein said stiffening means comprises a wooden bar disposed within said box of said at least one lower base member and firmly connected to the base surface of said box by a glue joint such that said wooden bar and said lower base member function as a one piece integral element to provide a statically cooperating and interacting unit with an increased ability to withstand pressure forces.

18. The carrier element of claim 16 wherein said stiffening means comprises a corrugated plate connected to the bottom of said at least one lower base member.

* * * * *